US011426720B2

(12) United States Patent
Tesch

(10) Patent No.: US 11,426,720 B2
(45) Date of Patent: Aug. 30, 2022

(54) PIPETTE FOR USE WITH A PIPETTE TIP

(71) Applicant: Eppendorf AG, Hamburg (DE)

(72) Inventor: Florian Tesch, Hamburg (DE)

(73) Assignee: Eppendorf AG, Hamburg (DE)

( * ) Notice: Subject to any disclaimer, the term of this patent is extended or adjusted under 35 U.S.C. 154(b) by 331 days.

(21) Appl. No.: 16/737,483

(22) Filed: Jan. 8, 2020

(65) Prior Publication Data

US 2020/0215529 A1 Jul. 9, 2020

(30) Foreign Application Priority Data

Jan. 8, 2019 (EP) ..... 19150808

(51) Int. Cl.
*B01L 3/02* (2006.01)

(52) U.S. Cl.
CPC ..... *B01L 3/0227* (2013.01); *B01L 2200/023* (2013.01); *B01L 2200/14* (2013.01); *B01L 2300/06* (2013.01); *B01L 2300/0832* (2013.01); *B01L 2400/0487* (2013.01)

(58) Field of Classification Search
None
See application file for complete search history.

(56) References Cited

U.S. PATENT DOCUMENTS 6,199,435 B1 * 3/2001 Wilmer ..... B01L 3/0279 73/864.14
2003/0074988 A1 4/2003 Suovaniemi et al.
2007/0272037 A1 * 11/2007 Telimaa ..... B01L 3/0217 422/400
2012/0148459 A1 * 6/2012 Sarna ..... B01L 3/0279 422/516
2013/0199312 A1 * 8/2013 Wilmer ..... B01L 3/0279 73/864.14

FOREIGN PATENT DOCUMENTS

| | | | |
|---|---|---|---|
| DE | 2711124 | B1 | 9/1978 |
| DE | 10355914 | B3 | 8/2005 |
| DE | 102006036764 | B4 | 11/2012 |
| DE | 202014101440 | U1 | 6/2014 |
| EP | 0992288 | B1 | 12/2000 |
| EP | 1689528 | B1 | 8/2006 |
| EP | 2470302 | A2 | 3/2011 |
| WO | 2011/025399 | A2 | 3/2011 |

* cited by examiner

*Primary Examiner* — Matthew D Krcha
*Assistant Examiner* — Brittany I Fisher
(74) *Attorney, Agent, or Firm* — Barclay Damon LLP

(57) ABSTRACT

A pipette comprises a pipette housing comprising an upper end and a lower end, a nipple configured to contact and retain a pipette tip, a drive apparatus configured to aspirate a liquid specimen into the pipette tip and expel the liquid specimen from the pipette tip, and an ejection apparatus. The ejection apparatus comprises a curved support rotatably mounted within the pipette housing, an ejection rod, a first sensing element positioned on the ejection rod and configured to be guided on a first curve on a perimeter of the curved support, and an operating element coupled to the curved support and configured to rotate relative to the pipette housing. The ejection apparatus is configured to rotate the curved support out of a start position by rotating the operating element. The first curve displaces the first sensing element downward a the ejection rod moves the pipette tip off of the nipple.

18 Claims, 9 Drawing Sheets

52
62
64
4
10
53
3
46
47
42
41
33,40
38
39
36
32
28
18
2
1

PIPETTE FOR USE WITH A PIPETTE TIP

CROSS REFERENCE TO RELATED INVENTION

This application is based upon and claims priority to, under relevant sections of 35 U.S.C. § 119, European Patent Application No. 19 150 808.4, filed Jan. 8, 2019, the entire contents of which are hereby incorporated by reference.

BACKGROUND

The invention relates to a pipette for use with a pipette tip.

Pipettes are utilized in particular in scientific and industrial laboratories in medical, molecular biological and pharmaceutical areas of application for dosing selected volumes of liquids. The liquids can in particular be homogeneous (single phase) liquids consisting of a single liquid component, or a homogeneous mixture of a plurality of liquid components (solutions). Furthermore, the liquids can be heterogeneous (multiphase) mixtures of a liquid with another liquid (emulsions), or a solid (suspensions).

Pipettes have a stick-shaped pipette housing with a nipple (attachment) on the bottom end for clamping on a pipette tip. The nipple is frequently a conical, cylindrical or sectionally conical and cylindrical projection, and is also termed a "working cone". A pipette tip is a hollow tube with a tip opening in the bottom end and a mounting opening in the upper end with which the pipette tip can be clamped to the nipple. The liquid is drawn into the pipette tip and discharged therefrom. The drawing and discharging of liquid is controlled by means of the pipette. Fixed volume pipettes serve to pipette constant volumes. With variable pipettes, the volume to be dosed is adjustable. A mechanical counter is used to display the set volume. To set the volume, the stroke of a drive apparatus is adjustable by means of a setting apparatus that is coupled to the counter. After use, the pipette tip is detached from the attachment, and can be exchanged for a fresh pipette tip. In this way, cross-contaminations in subsequent pipetting are avoided.

Air cushion pipettes have a plunger/cylinder system in the pipette housing that is connected by a channel to a through-hole in the nipple. Pipette tips for air cushion pipettes (air cushion pipette tips) do not have an integrated plunger. By displacing the plunger by means of the drive apparatus in the cylinder, an air cushion is moved for aspirating liquid into a pipette tip clamped onto the nipple, and ejecting it therefrom. A disadvantage with air cushion pipettes are dosing errors arising from the change in the length of the air cushion from the weight of the aspirated liquid, and the differences in temperature, air pressure and humidity. Contamination of the pipette with aerosols can also be problematic.

Positive displacement pipettes are used with pipette tips with integrated plungers (positive displacement pipette tips). This type of pipette has a nipple for fastening the pipette tip, and a drive apparatus that can be coupled to the integrated plunger (tip plunger) for moving the plunger. The plunger comes directly into contact with the liquid so that the effects of an air cushion do not exist. Positive displacement pipettes are in particular suitable for dosing liquids with a high vapor pressure, high viscosity or high density, and applications in molecular biology in which freedom from aerosols is important in order to avoid contamination.

Air cushion or positive displacement pipette tips for single use or reuse consist of plastic or of glass.

With the Biomaster® 4830 positive displacement pipette by Eppendorf AG, the drive apparatus has a stroke rod to displace a plunger in a pipette tip that has a hollow lower stroke rod part, and an upper stroke rod part inserted from the top into the lower stroke rod part. The upper stroke rod part is connected to an operating element that projects out of the upper end of the pipette housing. A Mastertip® pipette tip by Eppendorf AG can be clamped onto a nipple of the pipette. By pressing the operating element, the stroke rod can be shifted downward so that an upper end of the plunger rod of a plunger of the pipette tip is pressed into the bottom stroke rod part. When displacing the stroke rod downward to a bottom stop, a spring apparatus is pretensioned. After the operating element is released, the spring apparatus displaces the stroke rod to an upper stop, wherein the tip plunger is entrained and liquid can be aspirated into the pipette tip. The aspirated liquid can be discharged by again pressing the operating element to the bottom stop. To release the pipette tip, the user must press with greater force on the operating element so that another spring apparatus compresses, the upper stroke rod part in the lower stroke rod part is displaced downward and presses the plunger out of the lower stroke rod part, and presses the pipette tip off of the nipple.

To release the pipette tip from the pipette, the spring effect of the spring apparatuses must be overcome. This can be fatiguing for the user, in particular if the pipette tips have to be exchanged frequently. Furthermore, when dispensing highly viscous liquids and when quickly dispensing liquid from the pipette tip, it can occur that the pipette tip is released from the nipple due to the increased flow resistance in the tip opening.

EP 0 992 288 B1 describes a pipette with an ejection apparatus for a pipette tip in which a traction gear, pressure gear or linkage gear is integrated. Due to the transmission ratio of the gear, the ejection rod acting on the pipette tip travels a shorter path than the drive rod connected to an ejection button so that the ejection force is greater than the force for actuating the ejection apparatus. The ejection apparatus is arranged in the pipette housing on the side next to the drive apparatus for the displacement apparatus, whereby the pipette has a large overall volume. The pipette has the ejection button in addition to the operating button so that the user must grasp in order to eject the pipette tip after pipetting.

DE 103 55 914 B3 describes a pipette with an ejection apparatus that converts an axial movement of the actuating button into an axial and rotary movement of the ejector relative to the attachment. This reduces the applied force for actuating the ejector.

EP 1 689 528 B1 describes a pipette with a tip removal mechanism that contains a ramp element which is rotatable, has a circle-forming ramp surface and contains one or more segments, wherein the ramp surface has a high point and a low point in each segment. While rotating the ramp surface over a single segment, this forces an ejection element of the ejection apparatus to first move toward the tip and then to reverse. The known ejection apparatus is also arranged on the side next to the drive apparatus which makes the overall volume of the pipette large. Moreover, the ejection apparatus has a separate actuating button. This is configured as an electric pushbutton which controls a motor that rotates the ramp element by a gear. The structural complexity of the ejection apparatus is great.

DE 27 11 124 C2 describes a pipette that is connectable via a bayonet lock to a pipette tip. The pipette tip must be manually removed from the pipette. This may result in contamination.

DE 10 2006 036 764 B4 describes a pipette tip which has a latching element to latch with a mounting shaft, and a sealing region for sealing against the mounting shaft. In the region of the latching element, the pipette tip has a wall weakened by at least one slot running in the axial direction of the pipette tip. This can facilitate the sealing fixation of the pipette tip on the mounting shaft and the removal of the pipette tip from the mounting shaft. When pipetting highly viscous liquids and when pipetting quickly, the pipette tip can be pressed off of the shaft.

BRIEF SUMMARY OF THE INVENTION

Against this backdrop, the object of the invention is to provide a pipette that succeeds with a small construction volume, and wherein the ejection of a pipette tip requires a slight exertion of force. Moreover, the pipette is to be suitable for reliably securing a pipette tip on the nipple with a slight exertion force to prevent a pipette tip from being pushed off of the attachment while pipetting highly viscous fluids and while pipetting quickly.

An embodiment of a pipette for use with a pipette tip comprises a rod-shaped pipette housing, a nipple at the lower end of the pipette housing for holding a pipette tip, and a drive apparatus to displace a displacement element for aspirating a liquid specimen into a pipette tip held on the nipple, and for ejecting the specimen from the pipette tip. The pipette further comprises an ejection apparatus comprising a curved support that is rotatably mounted in the pipette housing and a first sensing element on an ejection rod and guided on a first curve on the perimeter of the curved support. The ejection rod is displaceably guided in the pipette housing in the longitudinal direction of the nipple. An operating element is connected to the curved support, projecting from the pipette housing, and rotatable relative to the pipette housing. The ejection apparatus is configured to rotate the curved support out of a start position by rotating the operating element, wherein the first curve displaces the first sensing element downward so that the ejection rod presses a pipette tip which is held on the nipple off of the nipple.

The curved support can rotate in the pipette housing and is immovably mounted in the pipette housing in the longitudinal direction of the nipple. The first sensing element is guided on a first curve on the perimeter of the curved support. Furthermore, the first sensing element is arranged on an ejection rod that is displaceably guided within the housing in the longitudinal direction of the nipple. Consequently, a rotary movement of the curved support is converted into a linear movement of the ejection rod. The rotary movement is produced by an operating element that projects from the pipette housing, and can rotate relative to the pipette housing, and is connected to the curved support. The operating element projecting from the pipette housing can be manually actuated by the user. Accordingly, by manually rotating the rotational axis of the operating element preferably by less than 360° (hereinafter also termed "pivoting"), the ejection rod in the pipette housing can be displaced in the longitudinal direction of the nipple. In this downward displacement, the ejection rod presses a pipette tip held on the nipple off of the nipple. To accomplish this, the ejection rod preferably can be pressed by its lower end against the top side of the pipette tip, preferably against the top side of a piston rod of a syringe piston, or against the top side of a collar of the pipette tip. Consequently, the pipette tip can be ejected from the pipette by manually rotating the operating element. Furthermore, the contour of the curve on the curved support can enable the force for actuating the operating element to be smaller than the force needed for ejecting the pipette tip. Moreover, a rotatably mounted curved support can be accommodated in the housing in a space-saving manner. In particular, the curved support can be configured and arranged so that at least part of the drive apparatus is arranged within the curved support in a space-saving manner. This can reduce the construction volume of the pipette.

According to one embodiment, the ejection apparatus (hereinafter also termed "pivotable") is configured so that the curved support is only partially rotatable about its rotational axis, i.e., around an angle of less than 360°, preferably less than 180°, more preferably less than the 90°, in order to press the pipette tip off of the nipple. This can be achieved in that the first curve on the perimeter of the curved support only extends over a corresponding angular range of less than 360°, and/or by stops limiting the movement of the curved support and/or the operating element. The invention however also refers to embodiments in which the curved support can rotate completely once, several times or as often as desired about its rotational axis in order to press the pipette tip off of the nipple.

According to another embodiment of the invention, the nipple has means for the form-fit connection to a pipette tip so that a pipette tip can be shoved onto the nipple while elastically constricting the nipple, and/or while elastically expanding the pipette tip before its form-fit connection with the nipple, a locking apparatus comprising a locking sleeve arranged concentric to the nipple and a control rod projecting upward from the locking sleeve are displaceably guided toward the nipple in the pipette housing, a second sensing element projects from the control rod, and the curved support has a second curve on the perimeter on which is guided the second sensing element which is configured so that, when the operating element is arranged in the start position, the locking sleeve borders the nipple on the inside when in a locked position, and/or borders the pipette tip on the outside, whereby the locking sleeve prevents a release from the nipple of the pipette tip connected in a form-fit to the nipple, and the locking sleeve is displaceable upward by rotating the operating element so that the nipple and/or the pipette tip is at least partially released, and the ejection rod presses the pipette tip off of the nipple.

In this embodiment, the forces can be reduced for connecting the pipette tip to the nipple and for removing the pipette tip from the nipple, and the pipette tip is nonetheless held sufficiently tightly on the nipple so that it is not released from the nipple when pipetting highly viscous fluids and when pipetting quickly. Connecting the pipette tip to the nipple is facilitated in that the nipple can be elastically constricted by shoving on the pipette tip, and/or the pipette tip can be elastically expanded by the penetration of the nipple. The elastic constriction and/or expansion is effectuated by the force acting between the means for the form-fit connection of the pipette tip and the nipple when shoving the pipette tip onto the nipple. The elastic constriction and/or elastic expansion is entirely or partially reversed if, when shoving on, the means for the form-fit connection of the pipette tip reach the means for the form-fit connection of the nipple, and the pipette tip enters into the form-fit connection of the nipple. Then the at least one locking sleeve is displaced into the locked position. This secures the pipette tip on the nipple since the locking sleeve in the locked position prevents the nipple from elastically constricting, and/or the pipette tip from elastically expanding, which is necessary to release the form-fit connection between the nipple and pipette tip. To eject the pipette tip from the pipette, the locking sleeve is removed from the locked position so that it at least partially releases the nipple and/or the pipette tip, and the nipple can be elastically constricted, and/or the pipette tip can be elastically expanded. Consequently, the form-fit connection is releasable with a slight exertion of force, and the pipette tip is releasable from the nipple. Moreover, the displacement of the locking sleeve is controlled by the curved support that has a second curve for this. The shape of the second curve and its position relative to the first curve on the curved support can ensure that the locking sleeve is removed from the locked position in a timely manner before the ejection rod presses against the pipette tip.

For the elastic constriction, the nipple can have at least one slot running in a longitudinal direction. In this case, the nipple can consist of a hard elastic or soft elastic material, such as a metal or plastic. A nipple produced from a soft elastic material such as from silicone rubber, a thermoplastic elastomer or rubber can also have sufficient elasticity for elastic constriction without a slot. For the elastic expansion, the pipette tip can have at least one slot running in the longitudinal direction on the upper end. In this case, the pipette tip can consist of a hard elastic plastic such as polypropylene or polyethylene, or soft elastic plastic. It is furthermore possible to produce a pipette tip from a soft elastic material at least at the upper end, for example from silicone rubber, a thermoplastic elastomer or from rubber so that it has sufficient elasticity for elastic expansion without a slot. The pipette tip can be produced by multi-component injection molding from a plurality of materials. In so doing, the various materials can be connected to each other physically and/or chemically. In particular, they can be connected to each other in a form-fit and/or integrally (for example by adhesion or welding). The locking sleeve is configured so that it does not deform when stressed with a radial force that is suitable to elastically constrict the nipple, and/or elastically expand the pipette tip. The locking sleeve consists for example of a metal, or a hard elastic, or rigid plastic.

According to another embodiment of the invention, the curved support is a rotating sleeve, i.e., a rotatably mounted sleeve. The embodiment as a rotating sleeve enables particularly space-saving accommodation of at least part of the drive apparatus within the curved support.

According to another embodiment, the curved support has a rotational axis extended in the longitudinal direction of the nipple. This is advantageous for space-saving accommodation of the curved support. This can for example be arranged in a space-saving manner above the drive apparatus in the rod-shaped pipette housing. According to a particularly space-saving embodiment, the curved support is a rotating sleeve with a rotating axis extending in the direction of the nipple, and at least part of the drive apparatus is arranged within the rotating sleeve. According to another embodiment, the curved support has a rotational axis extending perpendicular to the longitudinal direction of the nipple.

According to another embodiment, the longitudinal direction of the nipple is simultaneously the longitudinal direction of the rod-shaped pipette housing, or substantially corresponds thereto. The longitudinal direction of the nipple is a direction in which a pipette tip can be shoved onto the nipple and removed from the nipple. The longitudinal direction of the pipette housing is its main direction of extension.

According to another embodiment, the first curve and/or the second curve is arranged on the outer perimeter of the curved support. This is for example the case when designing the curved support as a solid cylinder or as a rotating sleeve. According to another embodiment, the curved support is a rotating sleeve, and the first curve and/or the second curve is arranged on the inner perimeter of the curved support.

According to another embodiment, the first curve has symmetrically arranged sections on both sides of a high point, and/or the second curve has symmetrically arranged sections on both sides of a low point when the first and/or second sensing element is positioned in the start position so that the pipette tip can be pressed off of the nipple by rotating the operating element from the start position in different directions. This makes it possible for the user to select the direction of rotation of the operating element for ejecting the pipette tip.

According to another embodiment, the first curve is a first groove, and/or the second curve is a second groove. This yields a particularly reliable and force-saving guidance of the first sensing element, and/or the second sensing element, on the curved support. In another embodiment, the first curve and/or the second curve is formed on a face of the curved support, wherein the respective sensing elements can be pressed against the curve by a spring apparatus.

According to another embodiment, the first curve has the shape of an inverted, i.e., upside down, V, or U, or Y, and/or the second curve has the shape of an upright V or U. These embodiments enable the pipette tip to be ejected by optionally rotating the operating element in one of two different directions.

According to another embodiment, the first sensing element is a first pin, a rotatably mounted first ball, roller or sleeve, or a first roller bearing mounted on a first pin, and/or the second sensing element is a second pin, a rotatably mounted second ball, roller or sleeve, or a second roller bearing mounted on a second pin. The embodiment as a pin is structurally very simple. Embodiments with a rotatably mounted element or a roller bearing are particularly low-friction and can reduce the exerted force for actuation and wear.

According to another embodiment, the operating element for actuating the ejection apparatus is simultaneously an operating element for driving the drive apparatus. This enables a single-handed operation of the pipette without grasping. According to another embodiment, the pipette has an operating element for actuating the ejection apparatus, and another operating element different from this operating element for driving the drive apparatus.

According to another embodiment, the operating element can be displaced in the longitudinal direction of the nipple in order to drive the drive apparatus. With a curved support that has a rotational axis extending in the longitudinal direction of the nipple, pipetting can be controlled by displacing the operating element in the longitudinal direction of the nipple, and the ejection of the pipette tip can be controlled by rotating the operating element about the rotational axis.

According to another embodiment, the operating element is connected to the curved support for conjoint rotation, i.e., rotates in sync, so that the curved support precisely follows the rotation of the operating element. According to another embodiment, the operating element is connected by a gear unit (such as a gear train or a traction drive) to the curved support.

According to another embodiment, the drive apparatus has a transmission mechanism that is configured to displace a drive element of the drive apparatus alternatingly downward and upward when the operating element is sequentially displaced downward, between which the operating element is displaced upward. This embodiment is advantageous with an operating element that is displaceable in the longitudinal direction of the nipple to drive the drive apparatus. In the first downward displacement of the operating element, the drive element is displaced downward out of an upper position into a lower position; in the subsequent upward displacement of the operating element, the drive element retains its lower position, and in the subsequent downward displacement of the operating element, the drive element is displaced back into the upper position. This sequence can be repeated as frequently as desired.

According to another embodiment, the transmission mechanism is at least partially arranged within a rotating sleeve. This enables space-saving accommodation.

According to another embodiment, the rotating sleeve has parallel cutouts on two opposite sides of the rotational axis, the operating element comprises a laterally projecting operating lever on a support plate, the support plate has a curved slot that is configured to accommodate a sector of the sleeve and to be moved along this sector in the longitudinal direction of the nipple, and the support plate is connected via a transmission element to a drive of the transmission mechanism. According to another embodiment, the operating element can be displaced within a first housing slot extending in the transverse direction of the pipette housing, and within a second housing slot extending downward from the middle of the first housing slot in the longitudinal direction of the pipette housing so that it can pivot in opposite directions in the first housing slot in the start position at the upper end of the second housing slot, and can be moved in a straight line in the second housing slot.

In this embodiment, the operating element is connected for conjoint rotation to the rotating sleeve and can also be moved in the longitudinal direction of the nipple. This is achieved by guiding the operating element on the curved slot on a sector of the rotating sleeve. In addition, the movements of the operating element can be guided by the first housing slot around the rotational axis of the rotating sleeve, and by the second housing slot in the longitudinal direction of the nipple.

According to another embodiment, the rotating sleeve has a support ring at the upper end that connects the two sectors of the sleeve together. The sleeve is stabilized by the support ring. Furthermore, the support ring can prevent the operating element from being pulled off of the sector of the sleeve.

According to another embodiment, the first curve and/or the second curve is arranged below the cutouts in the perimeter of the rotating sleeve.

According to another embodiment, the pipette housing and the curved support have a magnet assembly and/or a spring assembly that is configured to independently displace the operating element into the start position. The magnet assembly comprises for example two permanent magnets, or one permanent magnet and one ferromagnetic component. The permanent magnets, or respectively the ferromagnetic component are held on the pipette housing and on the curved support so that they independently displace the operating element into the start position when they approach each other. This can also be achieved by a spring apparatus that is pretensioned when the curved support is rotated out of the start position and seeks to rotate the curved support back into the start position.

According to another embodiment, there is a third sensing element which is concentric to the nipple and is braced against the pipette housing via a spring and can be pretensioned by shoving a pipette tip onto the nipple so that, when a pipette tip is released from the nipple, the spring relaxes, and the third sensing element helps press the pipette tip off of the nipple. The third sensing element can in particular be a sensing element of a sensing apparatus for sensing the collar of a pipette tip as described in EP 18 168 763.3. In this respect, reference is made to the above application, the content of which is hereby incorporated into the above application.

According to another embodiment, the pipette tip is a positive displacement pipette, or an air cushion pipette.

According to an embodiment of a positive displacement pipette, the ejection rod is arranged within an axial bore in a stroke rod for displacing a tip plunger in the pipette tip, and is arranged with the lower end above a seat of the stroke rod for the lower end of the tip plunger of a pipette tip held on the nipple and engaging with the tip plunger in a through-bore in the nipple. The ejection of a pipette tip including a tip plunger of a positive displacement pipette is achieved.

According to an embodiment of an air cushion pipette, a displacement apparatus with a displacement element that can be displaced by a drive element of the drive apparatus is present in the pipette housing and is connected to a through-bore in the nipple, and the lower end of the ejection rod is arranged on the side next to the nipple. The ejection of a pipette tip of an air cushion pipette is achieved.

According to another embodiment, the pipette tip is a single channel pipette or a multichannel pipette. With a multichannel pipette, the curved support can control the ejection rod of a multichannel ejector.

BRIEF DESCRIPTION OF THE DRAWINGS

The invention is explained below based on the accompanying drawings of an exemplary embodiment. In the drawings.

In the present application, the expressions "upper" and "lower" as well as "vertical" and "horizontal" and terms derived therefrom such as "above" and "below", "standing upright" and "upside down" as well as "over each other" refer to an arrangement of the pipette in which the nipple is oriented vertically, and is located on the downwardly facing end of the pipette housing. With regard to the pipette tip, these expressions refer to a vertical orientation of the middle axis of the pipette tip, wherein the tip opening is arranged at the bottom, and the mounting opening is arranged at the top.

DETAILED DESCRIPTION OF THE INVENTION

Figure 1:
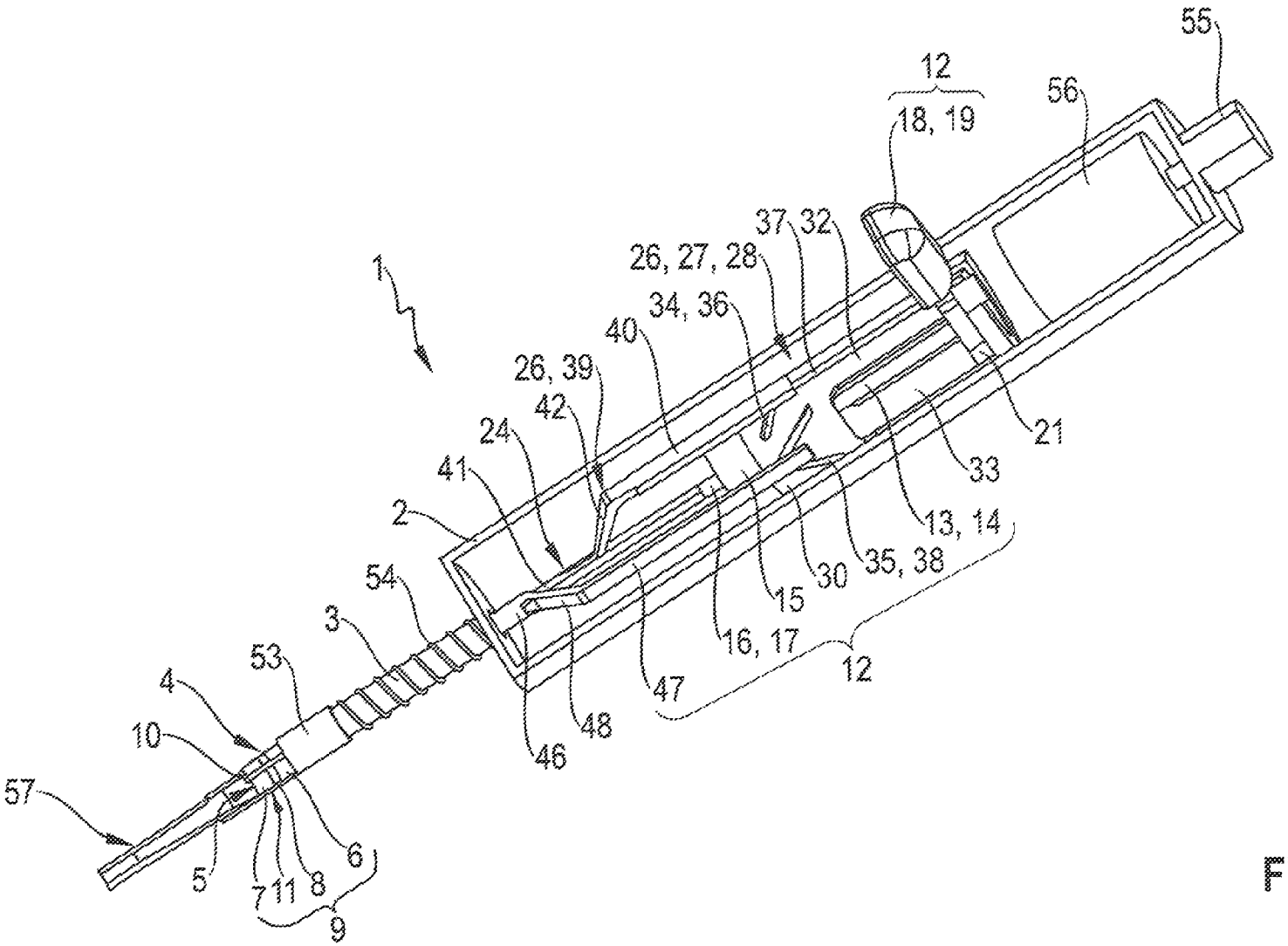
FIG. 1 illustrates a perspective view of an embodiment of a partially cut-away positive displacement pipette with a pipette tip mounted on the nipple.
Figure 2:
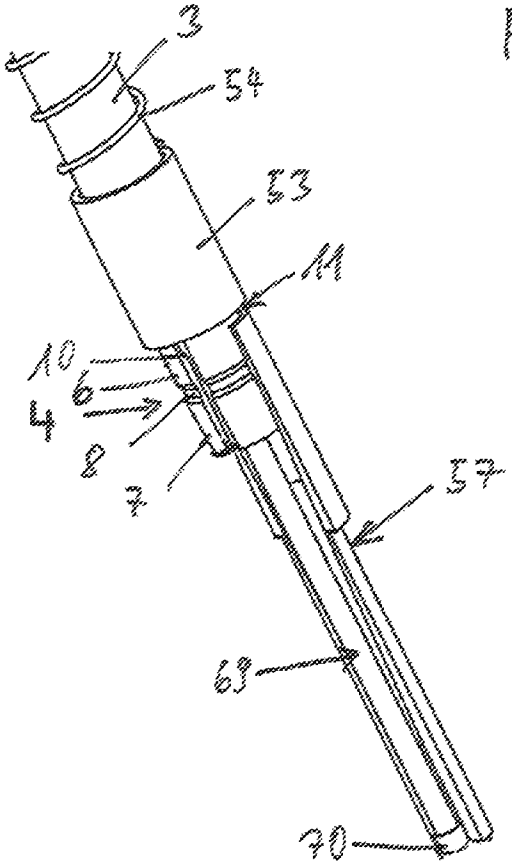
FIG. 2 illustrates an enlarged perspective view of an embodiment of a slotted nipple with an inner adjacent locking sleeve of the positive displacement pipette with a mounted pipette tip.
Figure 3:
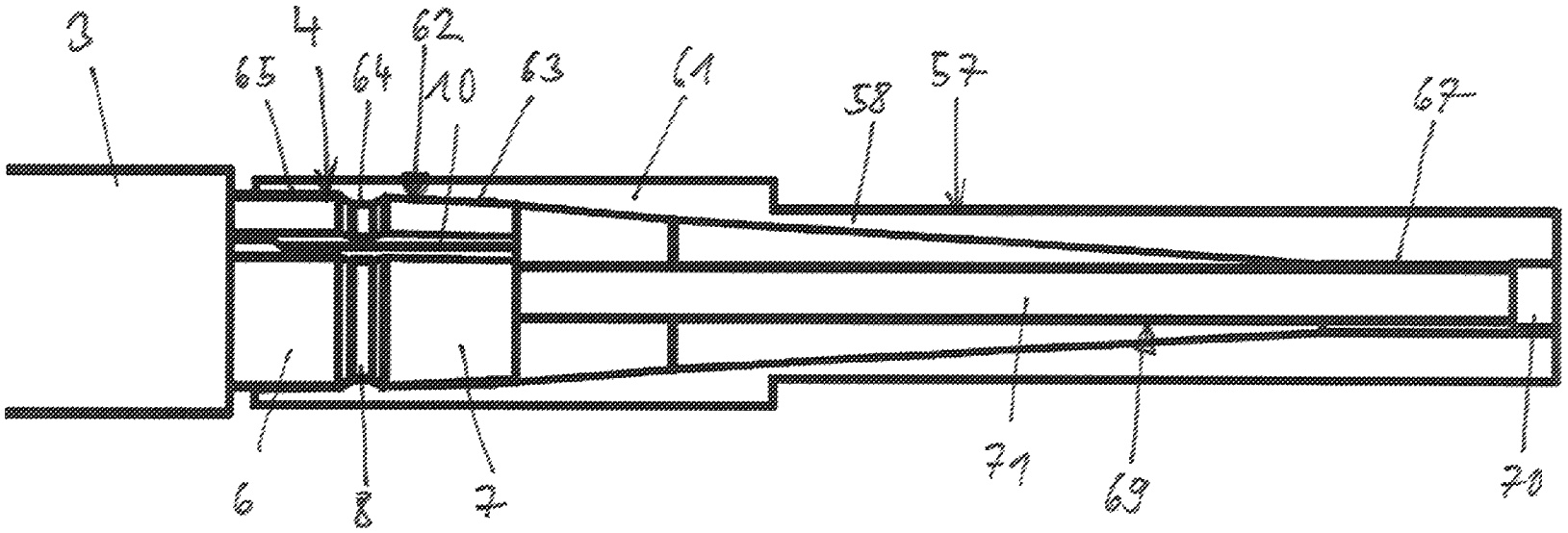
FIG. 3 illustrates a side elevational view of the embodiment of FIG. 2.

According to FIG. 1, a pipette 1 configured as a positive displacement pipette has a rod-shaped (e.g. cylindrical) pipette housing 2. From the lower end of the pipette housing 2, a hollow cylindrical shaft 3 projects downward. A nipple 4 projects downward from the lower end of the shaft 3 that, according to FIGS. 1 and 4, has a through-bore 5 with a through-hole in the lower end. The inner diameter of the through-bore 5 is smaller than the inner diameter of the shaft 3.

The nipple 4 has a top nipple section 6 in the shape of a hollow cylinder, and underneath, a lower nipple section 7 in the shape of a hollow cone. An annular groove 8 runs around the outer circumference of the nipple 4 between the upper nipple section 6 and the lower nipple section 7.

The upper nipple section 6, the annular groove 8 and the lower nipple section 7 form a first means for the form-fit connection 9 of the pipette to a pipette tip.

Furthermore, the nipple 4 has two slots 10, 11 running in its longitudinal direction that lie diametrically opposed to each other. The slots 10, 11 extend from the lower end over the entire length of the nipple 4.

Figure 5:
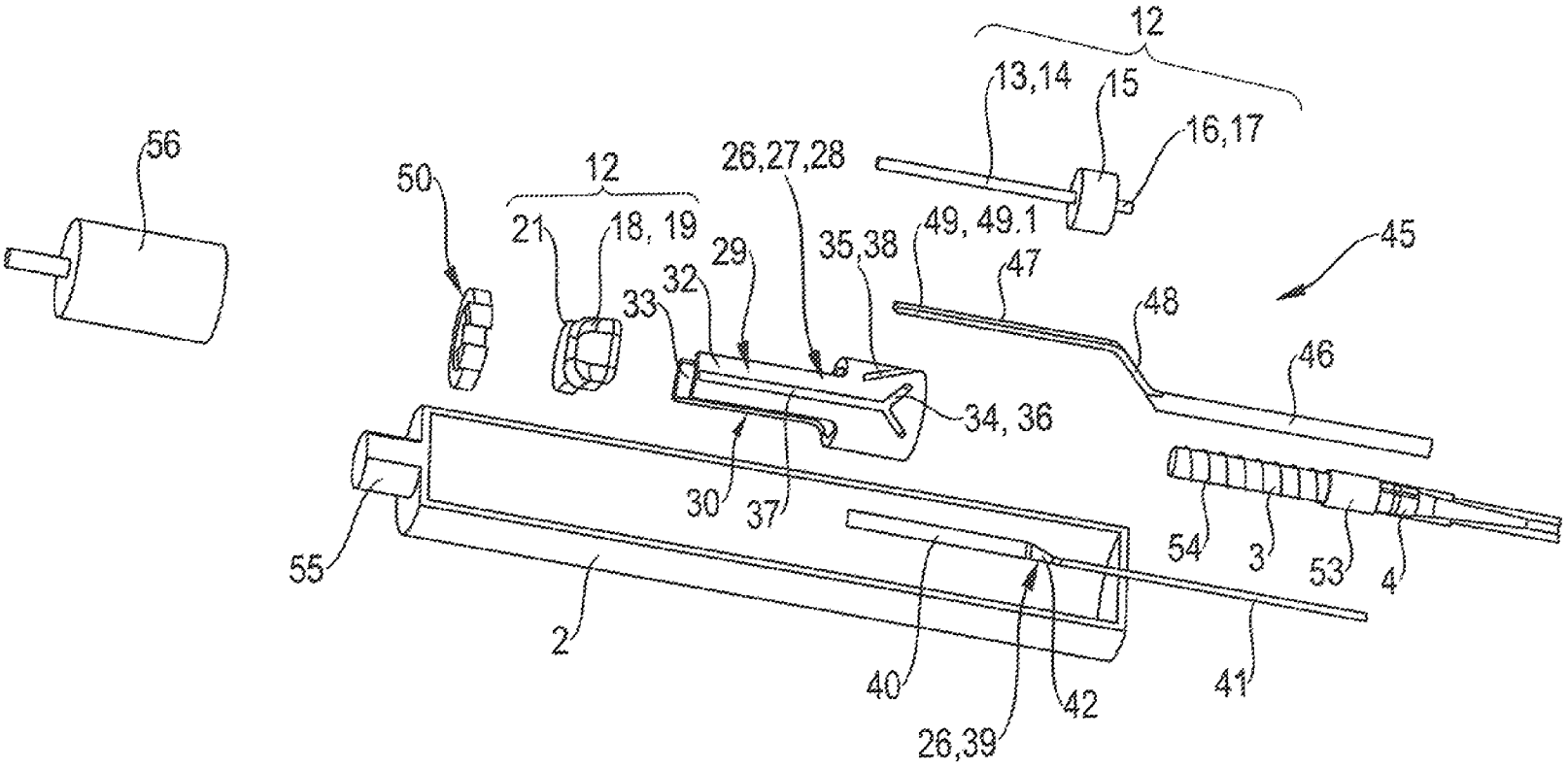
FIG. 5 illustrates and exploded view of the embodiment of FIG. 1.
Figure 6:
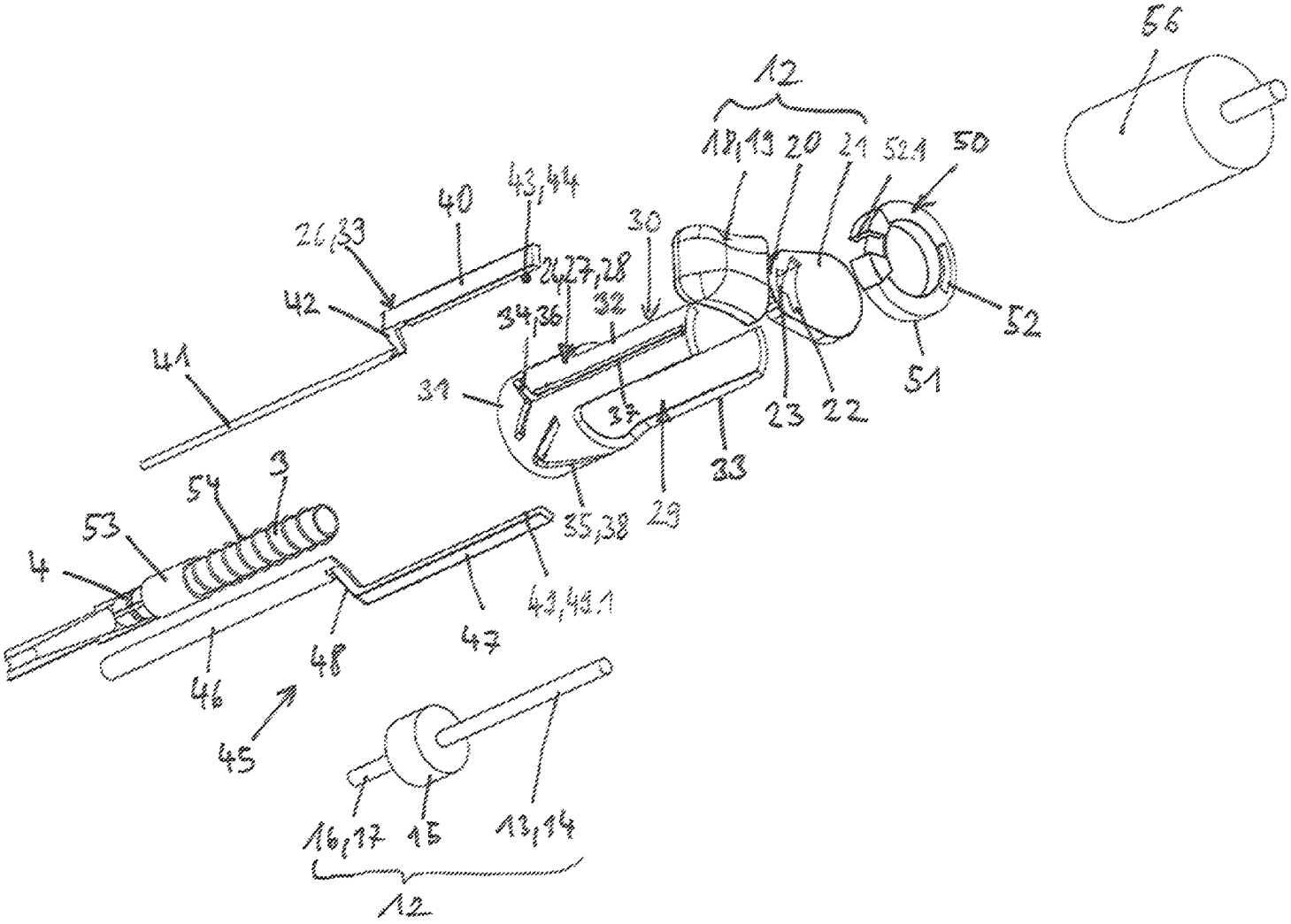
FIG. 6 illustrates an exploded view of the embodiment of FIG. 1 without the pipette housing.

According to FIGS. 1, 5 and 6, there is a drive apparatus 12 in the pipette housing 2 that comprises a transmission element 13 in the form of a transmission rod 14, a transmission mechanism 15 and a drive element 16 in the form of a stroke rod 17. Furthermore, the drive apparatus 12 comprises an operating element 18 in the form of an operating lever 19 that is securely connected via a bar 20 to a support plate 21.

According to FIG. 6, the support plate 21 has an oval shape with a wide, rounded end and a narrow rounded end, wherein the operating lever 19 projects from the edge of the narrow rounded end. In addition to this edge, the support plate 21 has a first curved slot 22 that runs approximately parallel to the contour of the narrow rounded end. Furthermore, the support plate 21 has a rectangular, first edge cutout 23 in the middle of the first curved slot 22 on the side of the narrow rounded end.

According to FIGS. 1 and 5, the stroke rod 17 is inserted from above into the shaft 3 and the nipple 4. According to FIG. 4, it is hollow and provided with a longitudinal slot 24 running in a longitudinal direction starting from the lower end. Because of the longitudinal slot 24, the stroke rod 17 has a C-shaped cross-section. Its lower end forms a seat 25 for the upper end of a plunger rod.

The transmission mechanism 15 is configured so that the stroke rod 17 is alternatingly displaced downward and upward during sequential downward displacements of the operating lever 19 between which the operating lever 19 is displaced upward. Consequently, by pressing the operating lever 19 downward, the stroke rod 17 can be displaced out of an upper position into a lower position, the stroke rod 17 retains the lower position during the subsequent upward displacement of the operating lever 19, and the stroke rod 17 is again displaced upward by subsequently pressing the operating lever 19 downward. This can be repeated as frequently as desired.

According to FIGS. 1, 5 and 6, the pipette 1 is provided with an ejection apparatus 26. This comprises a curved support 27 that is rotatably mounted in the pipette housing 2 and is configured as a hollow cylindrical rotating sleeve 28. The rotating sleeve 28 is for example rotatably mounted by its outer circumference on the inner circumference of the pipette housing 2, and the upper and lower ends are braced against ledges of steps on the inner circumference of the pipette housing 2 so that it cannot be displaced in an axial direction in the pipette housing 2. The rotational axis of the rotating sleeve 28 coincides with the longitudinal axis of the pipette housing 2 and the longitudinal axis of the nipple 4.

The rotating sleeve 28 has parallel cutouts 29, 30 on two diametrically opposite sides parallel to its rotational axis which extend from the upper edge of the rotating sleeve 28 and terminate at a distance from their lower edge. Below the cutouts, the rotating sleeve 28 accordingly consists of an annular base 31, and it also consists of two diametrically opposing sectors 32, 33 of an annulus that border the two cutouts 29, 30 on the side.

A first curve 34 and a second curve 35 are arranged on the outer circumference of the annular base 31 of the rotating sleeve 28. The first curve 34 is configured as a first groove 36 in the form of an inverted (upside down) Y. The vertical part 37 of the Y extends far upward to a sector 32 just short of the top edge of the sector 32. The second curve 35 is a second groove 38 in the outer circumference of the base 31 of the rotating sleeve 28 in the form of an upright V. The first curve 34 and the second curve 35 are arranged offset 90° relative to each other on the circumference of the rotating sleeve. The first curve 34 and the second curve 35 each extend over an angular range of less than 90° over the circumference of the rotating sleeve 28.

According to FIGS. 1, 5 and 6, the ejection apparatus 26 comprises an ejection rod 39 that comprises a strip-shaped or flat upper ejection rod part 40 and a cylindrical lower ejection rod part 41. The upper and the lower ejection rod part 40, 41 are parallel to each other and arranged laterally offset to each other. The lower end of the upper ejection rod part 40 is connected to the upper end of the lower ejection rod part 41 by a strip-shaped or flat connecting rod part 42 angled obliquely relative to the two ejection rod parts. A first sensing element 43 in the form of a first guide pin 44 extends at a right angle from the inside of the upper ejection rod part 40. The ejection rod 39 is preferably configured as a single part, for example from a rigid plastic.

Figure 4:
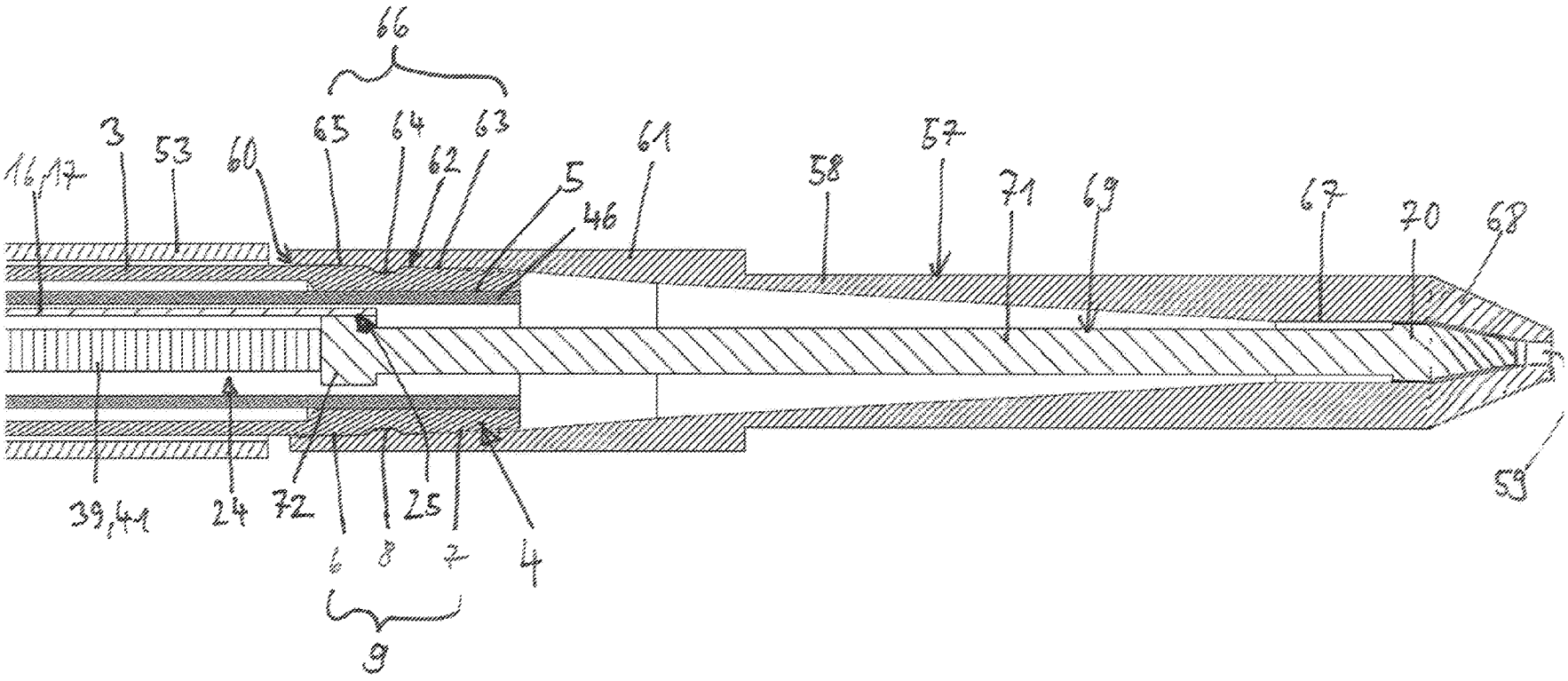
FIG. 4 illustrates a cross sectional view of the embodiment of FIG. 2.
Figure 7:
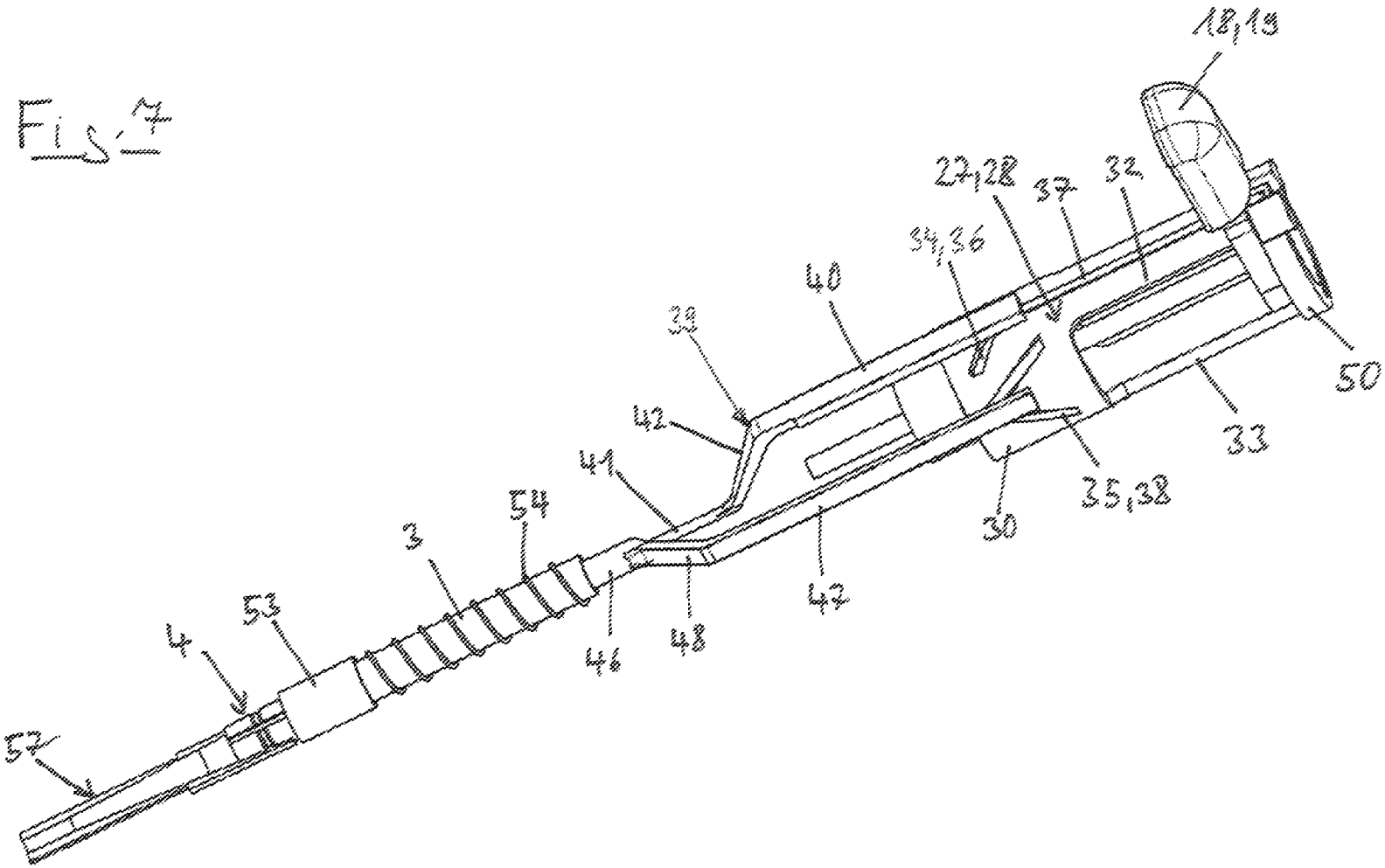
FIG. 7 illustrates a perspective view of an embodiment of a rotating sleeve with the ejection rod and the locking sleeve of the positive displacement pipette in the start position.

According to FIGS. 1, 4 and 7, the ejection rod 39 is guided by the guide pin 44 into the first groove 36, the connecting rod part 42 penetrates the longitudinal slot 24 of the stroke rod 17, and the lower ejection rod part 41 extends within the stroke rod 17 almost up to the lower bottom end thereof.

According to FIGS. 1, 4, 5 and 6, the pipette 1 comprises a locking apparatus 45 that comprises a locking sleeve 46 and a strip-shaped or flat control rod 47 parallel thereto. The upper end of the locking sleeve 46 and the lower end of the control rod 47 are connected to each other by a second connecting rod part 48 that is angled obliquely to the locking sleeve 46 and to the control rod 47. A second sensing element 49 in the form of a second guide pin 49.1 extends from the inside of the control rod 47.

According to FIGS. 1 and 7, the second guide pin 49.1 is guided in the second groove 38. According to FIGS. 1 and 4, the locking sleeve 46 is inserted from above into the shaft 3 and lies against the inner side of the nipple 4. The stroke rod 17 and the ejection rod 39 are inserted from above into the locking sleeve 46.

With the first curved slot 22, the operating element 18 is shoved onto the sector 32 of the rotating sleeve 28 on which the first groove 36 extends. According to FIGS. 1, 6 and 7, the rotating sleeve 28 is connected at the top to a support ring 50 that bridges the two sectors 32, 33 and stabilizes the rotating sleeve 28. On the outer edge, the support ring 50 has a downwardly projecting surface 51 that laterally surrounds the outer edges of the two sectors 32, 33. Furthermore, it has a second curved slot 52 that accommodates the upper edge of the sector 33 which is not provided with a groove 36, 38. On the diametrically opposite side, there is a rectangular second edge cutout 52.1 in the surface 51 that is open at the bottom and is configured to accommodate the bar 20 between operating lever 19 and support plate 21.

The support ring 50 is for example connected to the rotating sleeve 28 by adhesion.

The rotating sleeve 28 and the locking sleeve 46 as well as the operating element 18 are for example made of one or more rigid plastics and/or metal. The rotating sleeve 28, the support ring 50, the operating element 18 and/or the locking sleeve 46 are preferably each configured as a single part. An operating button of the operating element 18 can also be produced from an elastic or soft elastic plastic or rubber.

So that it can be operated from the outside, the operating lever 19 extends out of the pipette housing 2 through a first housing slot running transverse to the longitudinal axis of the pipette housing 2 and extending over a part of the circumference of the pipette housing 2. The first housing slot is connected in the middle to a second housing slot running in the longitudinal direction of the pipette housing 2.

Opposite the effect of a spring apparatus, the operating lever 19 can be displaced downward, starting from the support ring 50, along the second housing slot, wherein it slides with the first curved slot 22 on the sector 32 of the rotating sleeve 28. After being relieved, the spring apparatus independently displaces the operating lever 19 back upward.

A sleeve-shaped third sensing element 53 is guided on the outside of the shaft 3. A spring apparatus in the form of a helical spring 54 guided on the shaft abuts the bottom side of the pipette housing 2 and the top side of the third sensing element 53. By means of the helical spring 54, the sensing element 53 is pressed from above against a stop element on the shaft 3 or the nipple 4.

An adjusting knob 55 for adjusting a metering volume is arranged on the top side of the pipette housing 2. The metering volume can be adjusted by turning the adjusting knob 55. A counter 56 arranged thereunder in the pipette housing 2 indicates the adjusted metering volume in each case. The adjusting knob 55 and/or the counter 56 is coupled to the transmission mechanism 15. The transmission mechanism 15 is configured to change the stroke of the stroke rod 17 corresponding to the particular adjusted metering volume, which stroke is executed by the downward displacement of the operating element 18.

According to FIGS. 1 and 4, a pipette tip 57 is mounted on the nipple 4. The pipette tip 57 comprises a tubular body 58 that has a tip opening 59 in the bottom end, a collar 61 having a mounting opening 60 on the top end, and a seat region 62 on the inner circumference of the collar 61 for clamping onto the nipple 4. The seat region 62 has a contour complementary to the nipple 4 that has a conical, lower seat section 63 at the bottom for accommodating the conical lower nipple section 7, above which is a peripheral bead 64 for engaging in the annular groove 8 of the nipple 4, and above which is a cylindrical upper seat section 65 for accommodating the cylindrical upper nipple section 6. The lower seat section 63, the bead 64, and the upper seat section 65 form second means for the form-fit connection 66 of the pipette tip 57 with the pipette 1.

Below the seat region, 62, the tubular body 58 has a cylindrical plunger travel region 67. Thereunder, the tubular body 58 has a downwardly tapering tip section 68 with the shape of a conical frustum. The tip section 68 is shown in FIG. 4 and is omitted in the other drawings for reasons of simplification. A tip plunger 69 is inserted into the tubular body 58. This comprises a plunger 70 that is guided in the plunger travel region 67. A plunger rod 71 projects upward from the plunger 70 and has a smaller diameter than the plunger 70. At the upper end, the plunger rod 71 has a plunger head 72. According to FIG. 4, the plunger head 72 is pressed downward into the seat 25 of the stroke plunger 17.

Figures 8, 9, 10:
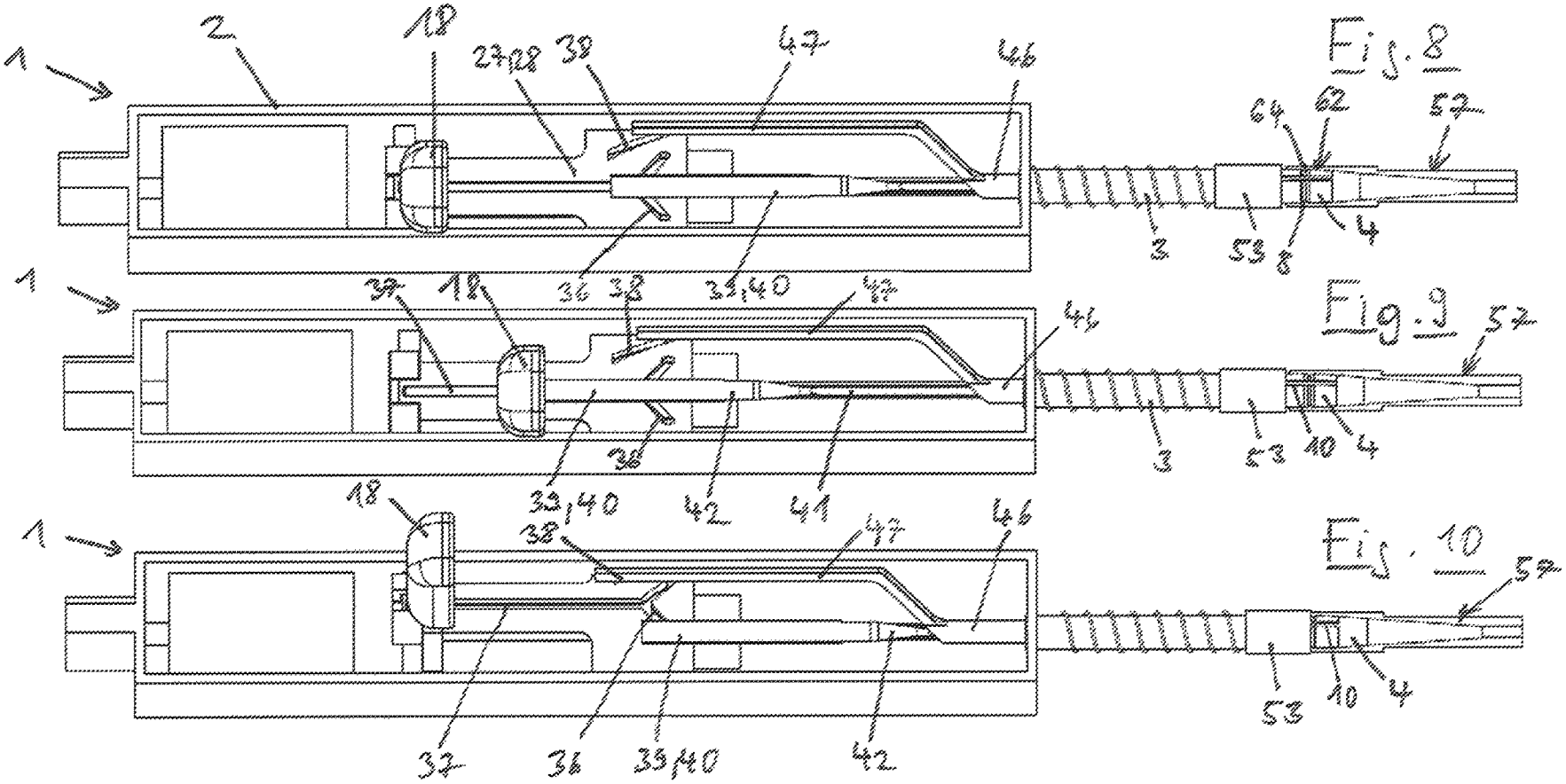
FIG. 8 illustrates a partial cut-away of the embodiment of FIG. 7.
FIG. 9 illustrates a partial cut-away of the embodiment of FIG. 7 while in a pipetting position.
FIG. 10 illustrates a partial cut-away of the embodiment of FIG. 7 in an ejecting position.

According to FIGS. 1 and 8, a pipette tip 57 is held on the pipette 1 in a starting state. The seat region 62 is in particular connected to the nipple 4 in a form-fit by the bead 64 engaging in the annular groove 8. The actuating element 18 is located in the starting position at the upper end of the second housing slot and can be screwed into the first housing slot in both directions. The maximum angle of rotation is limited by the extent of the first and second grooves 36, 38 in the circumferential direction, or the first housing slot depending on which extent is smaller.

The locking sleeve 46 is arranged in the lowest position according to FIG. 4 so that it prevents the pipette tip 57 from unintentionally releasing from the nipple 4. For the form-fit connection to be released, a radial constriction of the nipple 4 would in fact be necessary that the locking sleeve 46 does not permit in this position. In deviation from FIG. 4, the tip plunger 69 in the starting position does not yet press into the seat 25 of the stroke rod 17 with the plunger head 72.

To connect the tip plunger 69 to the stroke rod 17, the operating element 18 is pressed downward. The movement is transmitted by the transmission mechanism 15 to the stroke rod 17 so that it is pressed with the seat 25 onto the plunger head 72. This is shown in FIG. 4.

After being released, the operating element 18 is displaced back into its starting position by a spring apparatus according to FIG. 8. The stroke rod 17 and the tip plunger 69 maintain the positions according to FIG. 4.

To draw liquid, the pipette 1 is immersed in a liquid by the lower end of the pipette tip 57 held thereon. Then the operating element 18 is again pressed downward. This movement is converted by the transmission apparatus 15 into a stroke movement of the stroke rod 17. As a result, the tip plunger 69 is displaced upward. In so doing, the plunger head 72 entrains the ejection rod 39 so that the first guide pin 44 slides upward in the vertical part 37 of the Y-shaped first groove 36. During this, the locking sleeve 46 retains its position. This is shown in FIG. 9.

Once the operating element 18 has executed the set stroke, the pipette tip 57 is filled with a certain quantity of liquid. Then the operating element 18 is relieved and is displaced back upwards by the spring apparatus up to the stop on the support ring 50. To discharge this amount of liquid, the pipette tip 57 of the pipette 1 can be oriented over another vessel. By again pressing the operating element 18 downward, the stroke rod 17 is displaced downward, and the quantity of liquid is discharged. In so doing, the first guide pin 44 slides downward to the node point of the first groove 36.

The stroke executed by the operating element 18 while drawing and discharging liquid depends on the set amount of liquid. Drawing and discharging liquid can occur several times.

To eject the pipette tip 57, the operating lever 18 in the starting position is swung to the right or to the left. This rotates the rotating sleeve 28 so that the second groove 38 displaces the second guide pin 49.1, and therefore the locking sleeve 46, upward until the locking sleeve 46 has released the pin 4 until it can be deformed radially inward. To accomplish this, preferably the locking sleeve 46 is pulled out of the through-bore 5. Furthermore, by rotating the rotating sleeve 28, the first guide pin 44 is displaced downward in one of the two lateral sections of the bottom part of the first groove 36 so that the ejection rod 39 presses against the tip plunger 69 that abuts the tip section 68 at the bottom. In so doing, the bead 64 exerts a radial force on the nipple to constrict it, and the form-fit connection between pipette tip 57 and nipple 4 is released. This releases the pipette tip 57 from the nipple 4. This is shown in FIG. 10. The scraping of the pipette tip 57 off the nipple 4 can be assisted by the sensing element 53 that is pressed by the pretensioned helical spring 54 against the top edge of the pipette tip 57.

Once the used pipette tip 57 is released from the nipple 4, a new pipette tip 57 can be connected to the nipple 4. To accomplish this, the pipette 1 can be inserted with the nipple 4 into the seat opening 68 of a pipette tip 57 provided in a support. In so doing, the sensing element 53 is displaced upward and pretensions the helical spring 54. Furthermore, the plunger head 72 presses against the bottom side of the ejection rod 39 so that the first guide pin 44 slides up to the first branching point of the first groove 36. In so doing, the rotating sleeve 28 is rotated in the pipette housing 2 until the operating element 18 is located in the starting position. At the same time, the second guide pin 49.1 slides in the second groove 38 to the low point. This displaces the locking sleeve 46 into the locked position in FIG. 4 in which it prevents the pipette tip 57 from releasing from the nipple 4. Connecting the tip plunger 69 to the stroke rod 17 and pipetting can be carried out in the above-described manner.

Figure 11:
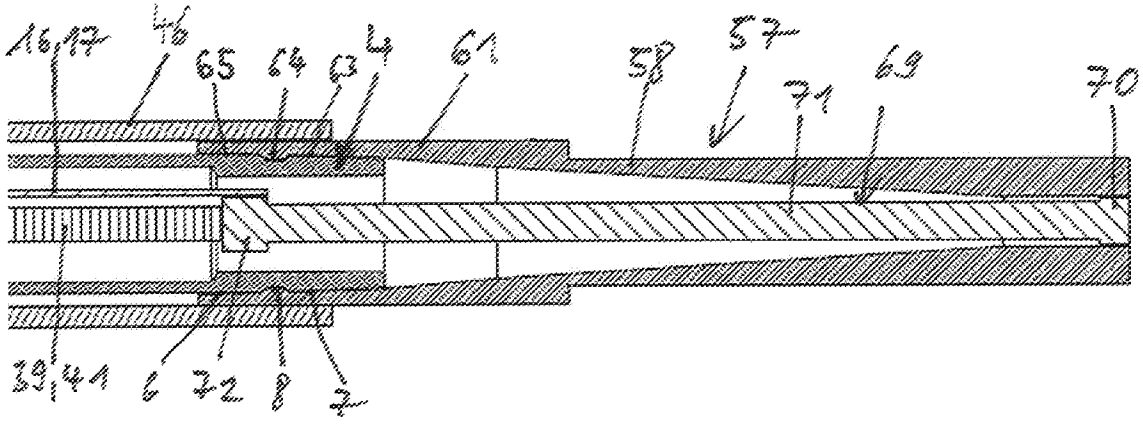
FIG. 11 illustrates a cross sectional view of an embodiment of a slotted pipette tip on a nipple of another positive displacement pipette with a locking sleeve lying on the outside of the pipette tip.

The exemplary embodiment in FIG. 1 differs from that described above in that the locking sleeve 46 is shoved in the locked position beyond the outer circumference of the collar 61 of the pipette tip 57. With this positive displacement pipette, pipette tips 57 are used that have at least one longitudinal slot proceeding from the upper end. The longitudinal slot enables a radial expansion of the pipette tip 57 in order to establish the form-fit connection of the pipette tip 57 with the nipple 4. The form-fit connection is prevented from releasing when the locking sleeve 57 is located in the locked position as shown in FIG. 11. To release the pipette tip 57 from the nipple 4, the locking sleeve 46 is displaced upward by means of the rotating sleeve 28 as in the above-described exemplary embodiment, and then the pipette tip 57 is released from the nipple 4 by pressing against the top side of the tip plunger 69.

REFERENCE SIGN LIST

1. Pipette
2. Pipette housing
3. Shaft
4. Nipple
5. Through-bore
6. Upper nipple section
7. Lower nipple section
8. Annular groove
9. First means for a form-fit connection
10. Slot
11. Slot
12. Drive apparatus
13. Transmission element
14. Transmission rod
15. Transmission mechanism
16. Drive element
17. Stroke rod
18. Operating element
19. Operating lever
20. Bar
21. Support plate
22. First curved slot
23. First edge cutout
24. Longitudinal slot
25. Seat
26. Ejection apparatus
27. Curved support
28. Rotating sleeve
29. Cutout
30. Cutout
31. Base
32. Sector
33. Sector
34. First curve
35. Second curve
36. First groove
37. Vertical part
38. Second groove
39. Ejection rod
40. Upper ejection rod part
41. Lower ejection rod part
42. Connecting rod part
43. First sensing element
44. Guide pin
45. Locking apparatus
46. Locking sleeve
47. Control rod
48. Second connecting rod part
49. Second sensing element
49.1 Second guide pin
50. Support ring
51. Surface
52. Second curved slot
52.1 Second edge cutout
53. Third sensing element
54. Helical spring
55. Adjusting knob
56. Counter
57. Pipette tip
58. Body
59. Tip opening
60. Mounting opening
61. Collar
62. Seat region
63. Lower seat section
64. Bead
65. Upper seat section
66. Second means for a form-fit connection
67. Plunger travel region
68. Tip section
69. Tip plunger
70. Plunger
71. Plunger rod
72. Plunger head

The invention claimed is:

1. A pipette for use with a pipette tip, the pipette comprising:

a pipette housing comprising an upper end and a lower end;

a nipple positioned on the lower end of the pipette housing and configured to contact and retain the pipette tip;

a drive apparatus configured to aspirate a liquid specimen into the pipette tip and expel the liquid specimen from the pipette tip; and an ejection apparatus comprising, a curved support rotatably mounted within the pipette housing, an ejection rod guided within the pipette housing in a longitudinal direction of the nipple, a first sensing element positioned on the ejection rod, wherein the first sensing element is configured to be guided on a first curve positioned on a perimeter of the curved support, and an operating element coupled to the curved support and configured to project from the pipette housing, the operating element configured to rotate relative to the pipette housing, wherein the ejection apparatus is configured to rotate the curved support out of a start position by rotating the operating element, and wherein the first curve displaces the first sensing element downward so that the ejection rod moves the pipette tip off of the nipple.

2. The pipette according to claim 1, wherein the nipple comprises a means for a form-fit connection to a pipette tip so that a pipette tip can be inserted onto the nipple while elastically deforming the nipple.

3. The pipette according to claim 2, wherein the pipette tip is configured to elastically expand before a form-fit connection with the nipple.

4. The pipette according to claim 2, further comprising a locking apparatus comprising, a locking sleeve arranged concentric to the nipple, a control rod configured to project upward from the locking sleeve, wherein the locking sleeve and the control rod are configured to be guided toward the nipple in the pipette housing, and a second sensing element configured to project from the control rod.

5. The pipette according to claim 4, further comprising a second curve positioned on the perimeter of the curved support and configured to guide the second sensing element.

6. The pipette according to claim 5, wherein when the operating element is in the start position, the second sensing element is configured so that the locking sleeve contacts at least one of the nipple and the pipette tip, wherein the locking sleeve prevents release of the pipette tip from the nipple, wherein the locking sleeve is configured to be displaced upward by rotating the operating element so that at least one of the nipple and the pipette tip is at least partially released, and wherein the ejection rod is configured to push the pipette tip off of the nipple.

7. The pipette according to claim 5, wherein when at least one of the first and second sensing elements is positioned in the start position, at least one of the first curve comprises symmetrically arranged sections on both sides of a high point, and the second curve comprises symmetrically arranged sections on both sides of a low point.

8. The pipette according to claim 5, wherein at least one of the first curve and the second curve comprises a groove.

9. The pipette according to claim 5, wherein the first curve comprises a shape of one of an inverted V, an inverted U, and an inverted Y, and wherein the second curve comprises a shape of one of an upright V and an upright U.

10. The pipette according to claim 4, wherein at least one of the first sensing element and the second sensing element comprises one of a guide pin, a rotatably mounted ball, a roller, a sleeve, and a roller bearing mounted on a pin.

11. The pipette according to claim 4, further comprising a third sensing element concentric with the nipple and configured to be braced against the pipette housing via a spring, and wherein the spring is configured to be pretensioned by moving the pipette tip onto the nipple so that, when the pipette tip is released from the nipple, the spring relaxes and the third sensing element helps move the pipette tip off of the nipple.

12. The pipette according to claim 1, wherein the curved support is a rotating sleeve having a rotational axis, and wherein at least part of the drive apparatus is positioned within the rotating sleeve.

13. The pipette according to claim 1, wherein the operating element of the ejection apparatus is simultaneously an operating element for driving the drive apparatus.

14. The pipette according to claim 13, wherein the operating element for driving the drive apparatus is configured to be displaced in a longitudinal direction.

15. The pipette according to claim 12, wherein the rotating sleeve comprises parallel cutouts positioned on two diametrically opposite sides, wherein the operating element comprises a laterally projecting operating lever on a support plate, and wherein the support plate comprises a curved slot configured to accommodate a sector of the rotating sleeve and configured to be moved along the sector in a longitudinal direction.

16. The pipette according to claim 15, wherein the pipette housing comprises a first housing slot and a second housing slot, wherein the operating element is configured to be displaced within the first housing slot, and wherein the operating element is configured to be displaced within the second housing slot starting from a middle of the first housing slot and extended in a longitudinal direction such that the operating element is configured to pivot in the first housing slot and is configured to move in a straight line in the second housing slot.

17. The pipette according to claim 15, wherein the rotating sleeve comprises a support ring positioned on one end of the rotating sleeve.

18. The pipette according to claim 1, wherein the pipette housing and the curved support comprise at least one of a magnet assembly and a spring assembly configured to independently displace the operating element into the start position.

* * * * *